US005367319A

United States Patent [19]

Graham

[11] Patent Number: 5,367,319

[45] Date of Patent: Nov. 22, 1994

[54] SECURITY PROTECTION FOR IMPORTANT DOCUMENTS AND PAPERS

[75] Inventor: Louis A. Graham, Greensboro, N.C.

[73] Assignee: Burlington Industries, Inc., Greensboro, N.C.

[21] Appl. No.: 921,399

[22] Filed: Jul. 30, 1992

Related U.S. Application Data

[60] Continuation-in-part of Ser. No. 26,488, Mar. 16, 1987, abandoned, and a continuation of Ser. No. 276,637, Nov. 28, 1988, abandoned, which is a continuation-in-part of Ser. No. 81,004, Aug. 3, 1987, abandoned, which is a continuation-in-part of Ser. No. 26,413, Mar. 16, 1987, Pat. No. 4,797,687, which is a continuation-in-part of Ser. No. 908,289, Sep. 17, 1986, abandoned, which is a division of Ser. No. 729,412, May 1, 1985, Pat. No. 4,650,694.

[51] Int. Cl.[5] ..... G01D 15/18; B42D 15/00; B41M 3/14

[52] U.S. Cl. ..... 347/2; 283/70; 283/72; 235/494; 427/7; 428/916; 347/74; 347/107

[58] Field of Search ..... 346/1.1, 75; 283/57–59, 70, 72, 74, 77, 85, 91, 901, 903, 904, 93; 427/7; 428/916; 235/380, 437, 468, 494

[56] References Cited

U.S. PATENT DOCUMENTS

| | | | |
|---|---|---|---|
| 4,025,925 | 5/1977 | Jensen et al. | 346/75 |
| 4,176,859 | 12/1979 | Giordano | 427/7 X |
| 4,234,214 | 11/1980 | Lee | 283/57 |
| 4,575,730 | 3/1986 | Logan et al. | 346/75 |
| 4,590,366 | 3/1986 | Rothfjell | 235/494 |
| 4,644,369 | 2/1987 | Gamblin et al. | 346/75 |
| 4,725,852 | 2/1988 | Gamblin et al. | 346/75 |
| 4,849,768 | 7/1989 | Graham | 346/1.1 |

*Primary Examiner*—Benjamin R. Fuller
*Assistant Examiner*—Alrick Bobb
*Attorney, Agent, or Firm*—Nixon & Vanderhye

[57] ABSTRACT

A method and apparatus for forestalling counterfeiting is disclosed which allows a counterfeit document to be identified relatively easily by an average person. The present invention employs a fluid jet applicator to record a unique, random pattern on each of a set of documents (e.g., paper currency, corporate or government bonds or any other document or important paper). Thus, a fluid jet applicator is controlled to produce a truly unique pattern on a set of original documents. Any counterfeiter who merely copies one (or a number) of the genuine documents would be left with a plurality of identical (i.e., non-unique) documents which may then be readily identified by a recipient as not being genuine.

30 Claims, 5 Drawing Sheets

SECURITY PROTECTION FOR IMPORTANT DOCUMENTS AND PAPERS

CROSS REFERENCE TO RELATED APPLICATIONS

This is a continuation of application Ser. No. 07/276,637, filed Nov. 28, 1988, now abandoned, which is a continuation-in-part of patent application Ser. No. 07/081,004, filed Aug. 3, 1987 now abandoned, which is a continuation-in-part of application Ser. No. 026,413, filed Mar. 16, 1987, U.S. Pat. No. 4,797,687 which is a continuation-in-part of application Ser. No. 908,289, filed Sep. 17, 1986 now abandoned, which is a division of application Ser. No. 729,412, filed May 1, 1985, now U.S. Pat. No. 4,650,694. In addition, this application is a continuation-in-part of application Ser. No. 026,488, filed Mar. 16, 1987 now abandoned.

FIELD OF THE INVENTION

This application generally relates to the thwarting or forestalling of counterfeiting of valuable documents. More particularly, the invention relates to a method and apparatus for recording a unique, random pattern on at least a predetermined portion of each of a set of original documents using a fluid jet applicator. If two documents which are alleged to be members of the original set are discovered to have the same pattern disposed on the predetermined document portion, then one or both of the documents must be counterfeit.

For the purpose of this text, a set of "documents" includes, but is not limited to, sets of paper currency, government bonds, corporate bonds, passports, or the like. The apparatus of the present invention is capable of generating a unique, random pattern on each document no matter how many documents are in the set, e.g., millions of unique patterns may be generated.

BACKGROUND AND SUMMARY OF THE INVENTION

As the quality of the modern laser color copier increases, the potential for mass production of near perfect counterfeit documents comes closer to becoming a reality. In this regard, it is noted that the Xerox Quick Response Multicolor Printer (QRMP) developed by Xerox for the Department of Defense for highspeed map making applications, uses lasers to produce extremely high resolution color images. Machines of this ilk may be readily accessible in the not too distant future in thousands of offices throughout the country.

The widespread use of such photocopying machines would allow an office worker to make nearly perfect copies of an individual bill of currency. Clearly, this could transform counterfeiting from a crime committed by relatively few and demanding great expertise, into an impulse crime committed by great numbers of office workers.

The severity of this problem is magnified by the fact that the slightly raised print created by the fusing of toner particles gives copied bills a feel which simulates the raised ridges produced by the engraving process used to generate U.S. currency. Thus, the modern laser color copier (which is computer controlled to precisely copy color, contrast and brightness) has the capability of producing bogus currency which both looks and feels like genuine U.S. currency.

Various approaches have been proposed to deter such counterfeiters. For example, it has been suggested that complex, three dimensional plastic holograms be hot-pressed onto U.S. currency. Such holograms would be extremely difficult to copy exactly. Additionally, it has been proposed to dispose minute diffraction gratings into the currency to give the currency a prism-like ability to break white light into the colors of the spectrum. Although such techniques may be effective to forestall counterfeiting, questions have been raised as to whether either of these techniques could endure the wear and tear that bills typically encounter.

The present method and apparatus for forestalling counterfeiting allows a counterfeit document to be identified relatively easily by an average person. In contrast, many prior art counterfeiting thwarting approaches typically require an expert to examine documents with a microscope to identify counterfeit documents.

The present invention employs a fluid jet applicator to record a unique, random pattern on each of a set of documents (e.g., paper currency, corporate or government bonds or any other document or important paper). Focusing on paper currency, if, for example, a bank teller is presented with two allegedly genuine hundred bills which have had the random pattern of the present invention applied thereto, and if both bills are observed as having identical patterns, then at least one is automatically identified a counterfeit.

Thus, according to the present invention, a fluid jet applicator is controlled to produce a truly unique pattern on a set of original documents. Any counterfeiter who merely copies one (or a number) of the genuine documents would be left with a plurality of identical (i.e., non-unique) documents which may then be readily identified by a recipient as not being genuine.

Since any given denomination of paper currency is produced in virtually infinite quantities, it is necessary to utilize a pattern generating technique which produces truly random patterns for the present invention to be optimally effective. It is noted that, although having a generally similar "look" or overall appearance, a careful study of natural wood grain patterns or moire ("watered") silk patterns reveals that such patterns are essentially unique non-repetetive random patterns. The present invention controls a fluid jet applicator to produce such unique patterns and applies such patterns to paper currency or other documents to thwart counterfeiters.

The patterns produced by the present invention may be broadly denoted as "random interference" patterns. Such patterns may include wood grain, moire (watered) silk, waterfall or other related patterns.

Interference patterns (which are generically referred to as "moire" patterns in a May, 1963 Scientific American article, by Oster et al, pages 54–63) typically result from the superposition and resulting interference between two periodic sub-patterns (e.g., two angularly oriented gratings). Such interacting sub-patterns must have transparent interstices regions if they are to be superimposed.

The "moire" silk pattern shown on page 54 of the Oster et al article results from the superposition of two sets of nearly parallel cords to produce a fabric having a shimmering appearance resembling the wavelike reflections on the surface of a pool of water. The interference pattern phenomena is such that a tiny displacement between two nearly aligned arrays of lines will be greatly magnified.

In the present invention, an electrostatic jet applicator is uniquely controlled to selectively create random interference patterns which simulate wood grain, "moire" silk and other related patterns. Initially, the operation of the fluid jet applicator will be generally described followed by a detailed disclosure as to how the random interference patterns are generated and applied to paper currency or other document substrates.

The electrostatic fluid jet applicator of the present invention is designed to apply a fluid (e.g., ink) to a moving document substrate by: (a) selectively charging and recovering some of the fluid droplets continuously ejected from a stationary linear array of orifices affixed transverse to movement of the substrate, while (b) allowing remaining selectively uncharged droplets to strike the substrate (e.g., thereby forming an image on the substrate).

More particularly, fluid is supplied to a linear array of liquid jet orifices in a single orifice array plate disposed to emit parallel liquid streams. These liquid jets break into corresponding parallel lines of droplets falling downwardly toward the surface of a substrate moving transverse to the linear orifice array. A droplet charging electrode is disposed so as to create an electrostatic charging zone in the area where droplets are formed (i.e., from the jet streams passing from the orifice plate). A downstream catching means generates an electrostatic deflection field which deflects all charged droplets into a catcher where they are typically collected, reprocessed and recycled to a fluid supply tank. In this arrangement, only those droplets which happen not to get charged are permitted to continue falling onto the surface of the substrate.

In prior art fluid jet applicators, great care is typically taken to produce droplets that are regularly and precisely spaced, sized, and timed across the orifice array in order to permit proper use of the apparatus. It is well recognized that such uniform droplet production is adversely affected by non-uniform stimulation across the orifice array due to reflected and interfering waves (i.e., so as to produce "standing" waves) such that certain orifices do not have the appropriate stimulation while others have too much.

In accordance with conventional wisdom, prior art fluid jet applicators have been designed to eliminate or reduce such standing wave patterns in order to achieve proper applicator operation. In such applicators, the orifice plates have been limited in length, employed dampening control and many other techniques to eliminate the problems caused by standing wave patterns.

The fluid jet applicator of the present invention utilizes a piezoelectric crystal to artificially stimulate the fluid supply chamber with coherent acoustic energy to purposely generate and exploit the acoustic standing waves therein. As a result, although substantially uniformly sized droplets will be formed at substantially the same frequency from each orifice, individual droplets will be formed so as to be out of phase with adjacent neighbors in accordance with the standing acoustic wave pattern. By selecting only a very short print time, e.g., such that only one or two drops are formed within such a print time and by controlling the frequency of such print time, a wide range of aesthetically appealing, unique, random interference patterns can be created and applied to documents to thwart counterfeiting.

DETAILED DESCRIPTION OF THE INVENTION

Figure 1:
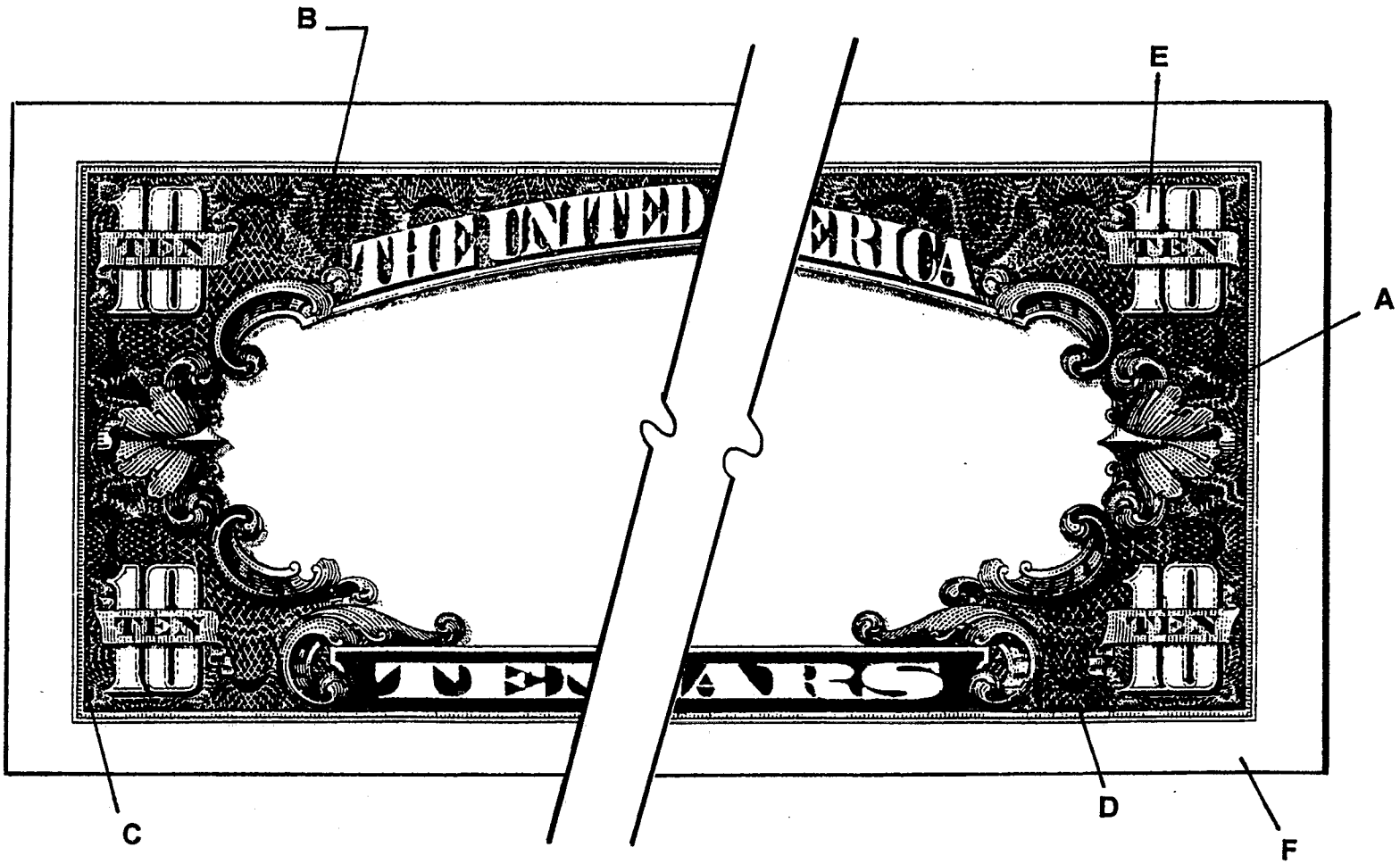
FIG. 1 is a schematic representation of a typical document showing exemplary areas wherein a random pattern according to the present invention may be applied to thwart counterfeiting.

In order to illustrate the present invention's approach to thwarting counterfeiting, first turn to FIG. 1, which is a schematic representation of a portion of a U.S. ten dollar bill. As noted above, each denomination of U.S. currency is produced by an engraving process in which intricate designs are engraved onto printing plates. Each of the vast quantities of genuine bills of a given denomination will include an exact copy of the pattern for that denomination.

Such intricate designs, as for example, shown in the border area in the vicinity of point A in FIG. 1 are extremely difficult to precisely duplicate on counterfeit printing plates. Nevertheless, once particularly skillfully engraved counterfeit plates have been manufactured (or if a technologically advanced color laser copier is used to produce counterfeit bills), it is extremely difficult for the average person to identify a counterfeit bill. Such counterfeit bills of a given denomination are likely to be exact copies of each other (except for the serial number), notwithstanding whether they have been produced by an engraved printing process, a photocopying process, or by another counterfeiting technique.

According to the present invention, the process for producing currency or other documents would be modified to the extent that each and every document would include at least a predetermined area in which a unique, random pattern is recorded. Thus, a business person or bank cashier presented with several bills of the same denomination would visually inspect the predetermined area of the bills and check for a duplicate pattern. If an exact match is spotted, then one or both bills must be counterfeit.

In accordance with the present invention, a fluid jet applicator is controlled in a manner which will be described in detail below to apply a unique, random pattern to replace any or all of the predetermined decorative patterns presently on the currency. For example, such random patterns may be incorporated in one or all of the interior border areas labeled A–D in FIG. 1. Alternatively, such random patterns may be disposed in area E within the symbol defining the bill denomination, i.e., 10. As a further alternative such a random pattern may be disposed along the exterior border area F shown in FIG. 1.

A further embodiment of the present invention contemplates applying a random pattern to the document not with conventional printing ink, but rather with ultraviolet visible fluorescent brighteners (or similar compounds), which are normally invisible under normal lighting. When exposed to ultraviolet light these compounds become visible as intense whites of various tints (e.g., blue, pink, yellow, green) depending on the particular compound selected. Compounds exhibiting such properties are found, for example, in the stilbene family. A specific compound may be chosen depending upon its characteristics and the characteristics of the substrate. Thus, as will be appreciated by those skilled in the art, a compound known to fade upon excessive exposure to sunlight might be acceptable if applied to U.S. treasury bonds, but would not be acceptable on typical paper currency.

When using such compounds, the entire original document paper is treated by a fluid jet applicator controlled in the manner to be described below to create a random interference pattern using fluorescent brighteners. Paper so treated is thereafter subjected to conventional printing to create paper currency, governments, bonds, passports or other valuable documents. It is noted that alternatively the random pattern of fluorescent brighteners may be applied after the documents or currency have been printed.

When ultraviolet light visible compounds are used, the counterfeit checking process involves a two-step test. Initially, the documents, e.g., a couple of ten dollar bills, are exposed to a readily available source of ultraviolet light (commonly referred to as black light). If such exposure does not reveal the existence of a random pattern, then the documents are immediately identified as counterfeits. If a random pattern is spotted, a further check is then made to determine whether the bills have the identical pattern. If so, then one or both of the bills is a counterfeit.

The fluid jet applicator's potential for generating truly random patterns over the 5 to 6 inch length of a dollar bill, or the like may be appreciated by focusing on that fact that a fluid jet orifice plate having, for example, 144 jets per inch, when operated under typical operating conditions, creates virtually tens of millions of droplets per second. The present invention effectively taps this potential and uniquely controls the fluid applicator to generate a truly unique, random pattern on each document.

Thus, it is important to first focus on the general technique by which fluid jet applicators may be controlled to produce such unique, random patterns. In addition to the discussion which follows, further details regarding this technique are found in copending U.S. application Ser. No. 026,488, filed Mar. 16, 1987, which application is hereby expressly incorporated herein by reference.

If equal acoustic power is delivered to each orifice in an orifice array during normal operating conditions, an essentially straight print line in the cross-machine direction would be created by droplets striking the substrate. In the present invention, the fluid plenum is stimulated so as to purposefully generate standing waves, a condition which prior art jet applicators have sought to avoid. The frequency and amplitude of stimulation is selected not only to set up standing waves within the fluid plenum, but also to cause fluid filaments to break up into equal sized regularly spaced (in the vertical direction) droplets. (Typically, the filaments are also regularly spaced along the orifice plate by virtue of the spacing of the orifices in the orifice plate, but this is not absolutely necessary.)

Figure 2:
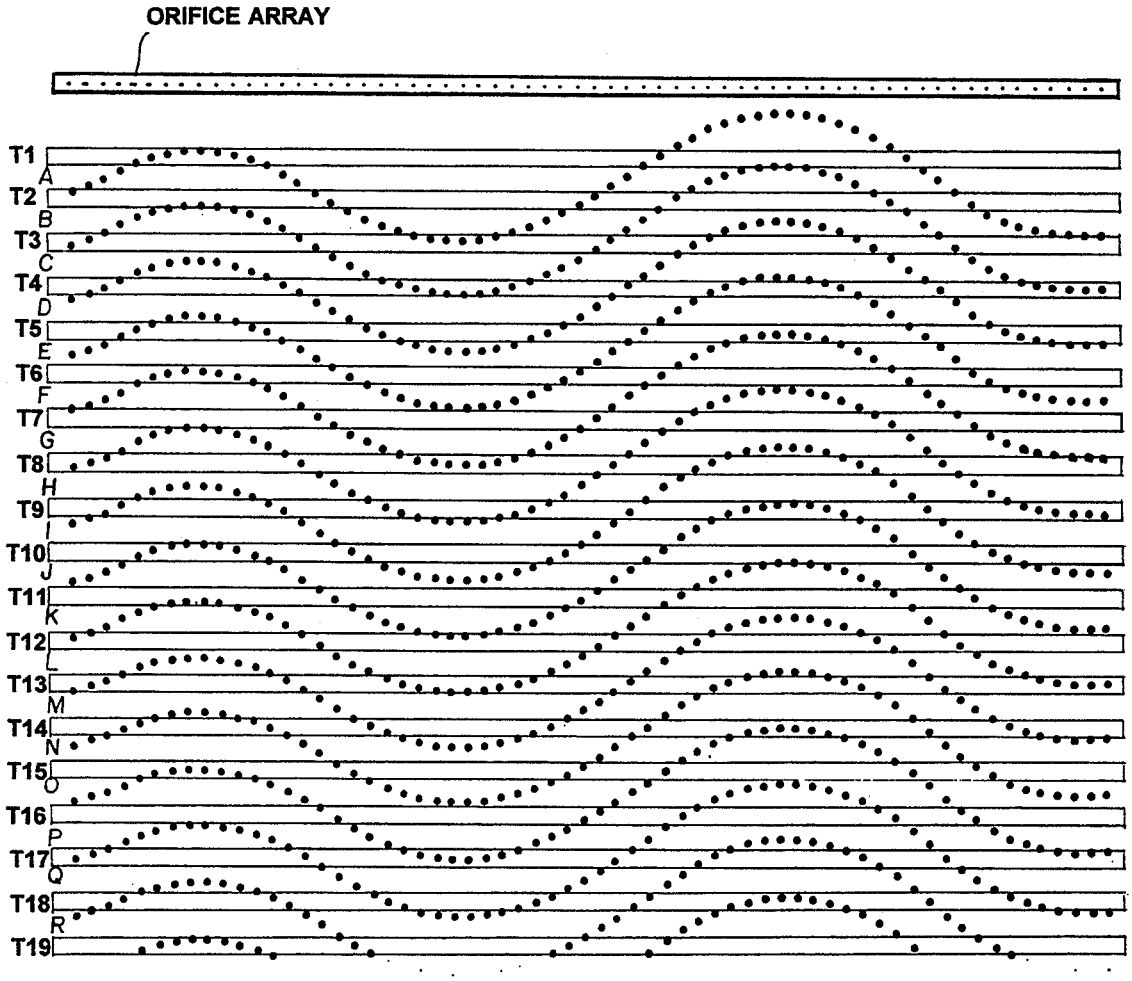
FIG. 2 is a schematic representation of curtain of droplets emanating from an orifice array under the influence of a standing wave pattern.

FIG. 2 is a schematic representation of a curtain of droplets emanating from an orifice array where standing waves have been set up within the fluid plenum. The frequency of stimulation is selected such that the filaments from each orifice break up into equal sized regularly spaced droplets (with respect to a droplet's vertically displaced neighbor) as is shown in FIG. 2. However, due to the presence of standing waves in the fluid plenum, in the cross-machine direction each droplet is not formed at precisely the same time as its left and right neighbors. As can be seen in FIG. 2, moving from left to right the droplet pattern of leading and lagging droplet formation times varies in a wave-like fashion. The wave pattern depicted in FIG. 2 is exemplary only. Many standing wave patterns can be produced. Moreover, the depiction in FIGS. 2 and 3 is theoretical only, to illustrate the concept of interference as applied in this invention.

The spacing between each droplet and its adjacent upper and lower neighbor can be described in terms of t, the period of the stimulation frequency applied to the fluid plenum. Thus, a droplet is formed and breaks off from each filament every t seconds, the droplet being out of phase with its right and left neighbors. If all the droplets emanating from the orifice array under the conditions shown in FIG. 2 were permitted to strike the substrate, (with the substrate moving at moderate speed) a solid shade would result.

By selectively controlling the on and off cycling of the charging voltage applied to the charging electrode(s), the applicator of the present invention can generate random interference patterns which simulate wood grain, watered (moire) silk and other related patterns. In order to generate a truly random interference pattern besides purposefully setting up standing waves, the present invention limits the print time period to a sufficiently small duration such that very few drops, usually two or less, are formed during the print time selected.

Figure 3:
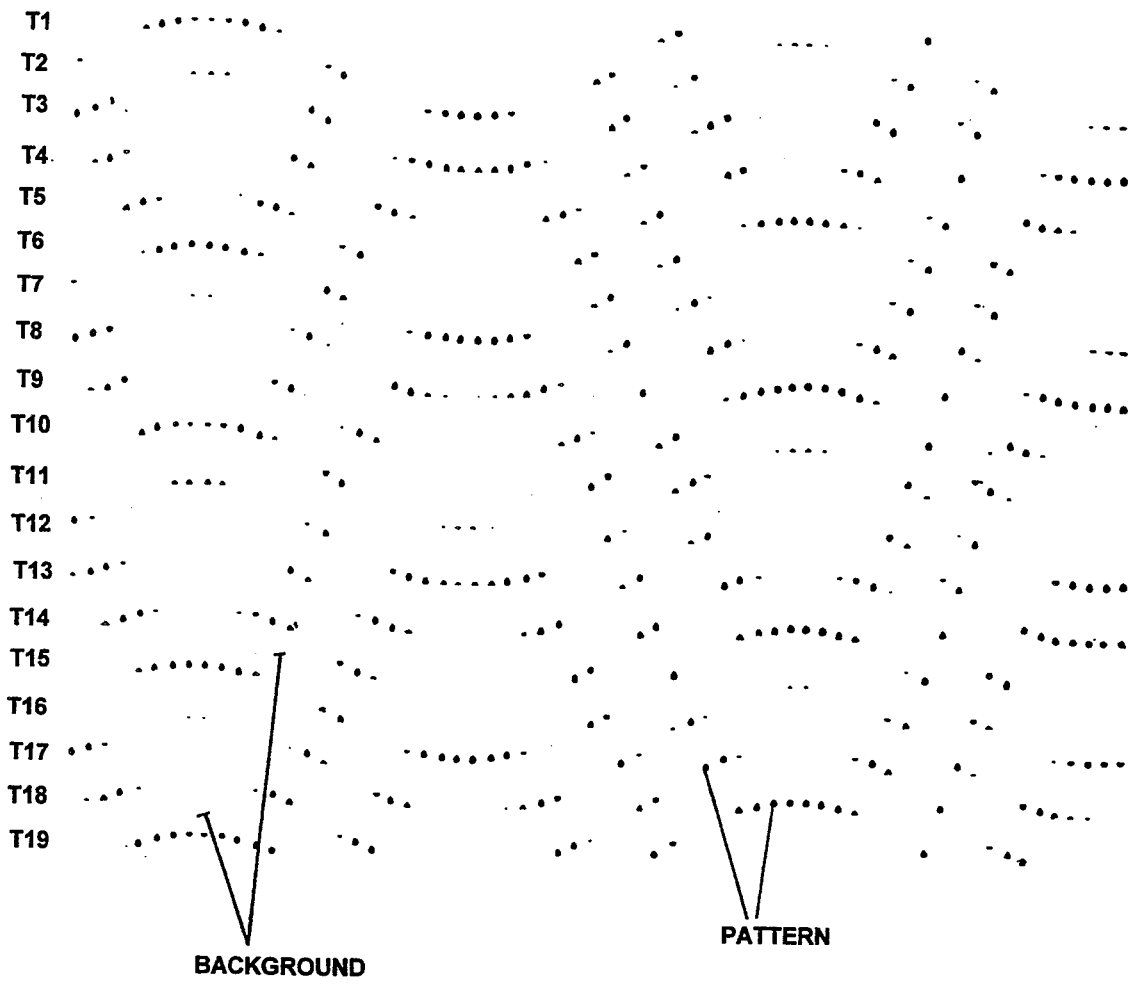
FIG. 3 is a schematic representation of a resulting random interference pattern appearing on a non-wicking substrate.

FIG. 3 schematically represents a random interference pattern which may be generated on a flat non-wicking substrate by exercising electrostatic control over the droplet curtain shown in FIG. 1. In this regard, if during the time intervals T1, T2 . . . T19 corresponding to the so-labelled bands in FIG. 2, no charging voltage is applied to the charge electrode (such as electrode 16 described below with respect to FIG. 4), no charge will be induced on the droplets which are then adjacent to the charge electrode. During these "print" times, such droplets will strike the moving substrate in the pattern shown in FIG. 3. By applying a charging voltage during time intervals TA, TB . . . TR, the droplets adjacent the charge electrode(s) during these intervals will have a charge imparted on them such that they will be deflected into the catcher.

As can be seen in FIG. 3, an undulating interference pattern is formed. The pattern has a greater thickness and amplitude, but similar cross-machine wave length to the standing wave pattern. It is the interaction (or interference) between the standing wave pattern and the ON/OFF pattern of the print cycle which results in a unique, random interference pattern which is printed onto a substrate which moves under the orifice array.

The pattern shown in FIG. 3 shows a dramatic accentuation of the cross-machine standing waving pattern. In practice, the interference pattern becomes more distinct as the print period is decreased. FIG. 3 schematically represents a fluid jet applicator set with a print time ON of 0.33 t and a print time OFF of 0.5 t, where t is the period of the stimulation frequency. It is noted that the near "negative" of FIG. 3 (i.e., the white portion of the FIG. 3 pattern will appear dark and the darker portion of the pattern will appear white) may be generated by utilizing a print time ON of 0.5 t and a print time OFF of 0.33 t (the reverse of the FIG. 3 conditions).

The interaction between the ON/OFF pattern of the print cycle and the standing wave pattern produces a unique, random interference pattern whether considered on a line by line or section by section basis. By modifying the ON/OFF pattern of the print cycle, while maintaining the print ON time below a predetermined maximum print time the resulting random interference patterns may be varied to produce random patterns having entirely distinct overall appearances.

By varying the standing wave pattern, the random interference patterns may likewise be varied. It is noted that varying standing wave patterns can be obtained by varying any of a number of parameters. These include the frequency of stimulation, the physical configuration of the print bar, the waveform of the stimulation frequency, the addition of harmonics to the stimulation frequency, variations of the bar pressure in the fluid plenum, the number of and spacing of the piezoelectric crystals 34 (see FIG. 4), the size of the orifices in the orifice plate, the viscosity of the print fluid, and the addition of other external vibration sources.

Turning back to FIG. 3, the random interference pattern shown therein includes patterns of dark undulations disposed on a white background. To produce this pattern, the print time selected is such that about one drop per orifice is formed for the dark pattern and no drops for the background. A variation of this effect may be produced by increasing the print time so that two drops appear in the pattern, and one drop appears in the background, thereby producing a contrasting background that has an attractive slightly shaded appearance.

Figure 4:
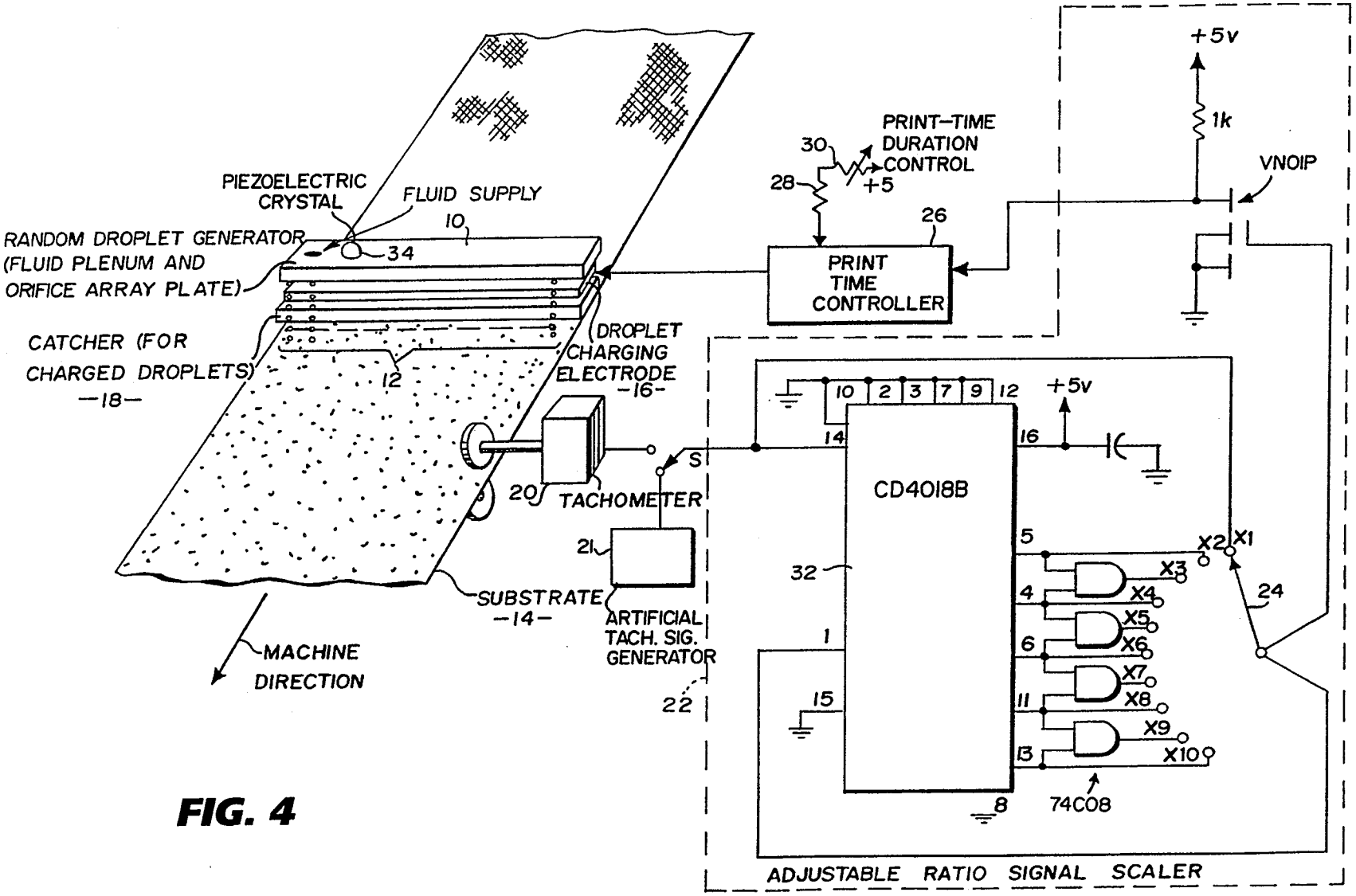
FIG. 4 is a schematic representation of an exemplary fluid jet applicator system in accordance with the present invention.

An exemplary fluid jet electrostatic applicator for practicing the present invention to generate random interference patterns is depicted in FIG. 4. This applicator is a modified version of the solid shade applicator described in U.S. Pat. No. 4,650,694, which patent is hereby expressly incorporated by reference herein.

Although the details of the fluid jet applicator described below in FIG. 4 relate to a "solid shade" applicator having one charged electrode, those skilled in the art will recognize that a pattern generating applicator having an array of charging electrodes likewise may be controlled to generate random interference patterns using the present invention. Such a pattern generating applicator may be advantageously controlled to, for example, generate the symbol "10" in a U.S. ten dollar bill with a superimposed random interference pattern within the ten (i.e., in area E of FIG. 1). Likewise, a pattern generating applicator may be used to outline any desired area of the paper currency within which a random pattern is desired to be superimposed.

In such a pattern generating applicator, if an image is to be printed, it may be conventionally stored in an electronic digital memory, in the form of binary-valued picture elements (which are typically referred to as pixels). Pixel size is determined by the spacing of charge electrode elements in the transverse direction, and longitudinally by the mechanical resolution of a rotary pulse generator (e.g., a tachometer as shown in FIG. 4), coupled to the movement of the substrate. Typically, but not necessarily, transverse and longitudinal resolution are made equal.

With each tachometer pulse, a new line of transverse image data may be transferred from the memory to an array of individual charge voltage control (i.e., charge driver) circuits, which apply a "print" pulse of zero volts to a particular charge element when a pixel is to be printed, or full charge voltage, (typically 150 volts), when a pixel is to be left blank, as determined by the image data for that element.

Turning now to FIG. 4, the exemplary fluid jet applicator includes a suitable pressurized fluid supply together with a fluid plenum which therein supplies a linear array of jet orifices in a single orifice array plate (which may, for example, be an orifice plate of the type disclosed in U.S. Pat. No. 4,528,070). The jet orifices are disposed to emit parallel liquid streams which break into corresponding parallel lines of droplets 12 falling downwardly toward the surface of a document containing substrate 14 moving in the machine direction (as indicated by an arrow) transverse to the linear orifice array.

A droplet charging electrode 16 is disposed so as to create an electrostatic charging zone in the area where droplets are formed (i.e., from the jet streams passing from the orifice plate). If the charging electrode 16 is energized, droplets then formed within the charging zone will become electrostatically charged. A downstream catching means 18 generates an electrostatic deflection field for deflecting such charged droplets into a catcher 18 where they are typically collected, reprocessed and recycled to the fluid supply. In this arrangement, only those droplets which happen not to get charged are permitted to continue falling onto the surface of substrate 14.

Figure 5:
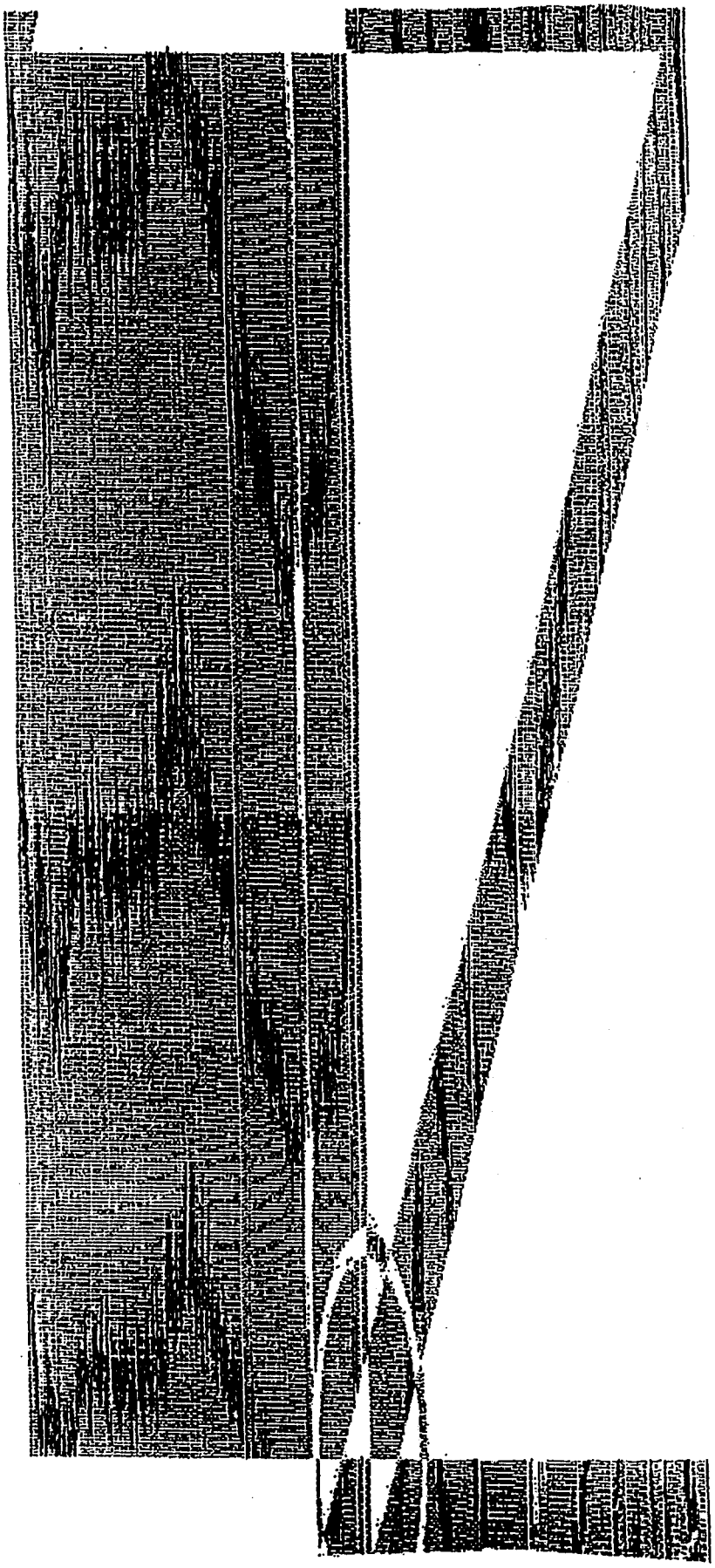
FIG. 5 is a photocopy of an exemplary random interference pattern specimen printed in accordance with the present invention.

In contrast with the solid shade applicator disclosed in application Ser. No. 908,289, the random droplet generator in the applicator of the present invention is stimulated artificially by piezoelectric crystal 34. Although a single crystal is shown in FIG. 5, it should be recognized that for the purposes of the present invention, a plurality of crystals may be utilized to acoustically vibrate the fluid plenum. Indeed, the standing wave patterns set up in the plenum can be modified greatly by adding crystals and varying the signals to them as set forth below.

In the present invention, the artificial stimulation produced by crystal 34 is designed to purposefully generate standing waves (even if they change with respect to time for generating the random interference patterns discussed above). Thus, the applicator need not include any mechanism for damping such standing waves.

The stimulation frequency is initially selected to make the filament lengths emanating from each orifice shorter and more uniform so that all the droplets will break off within the charge electrode region. Thus, although it is essential to generate standing waves to achieve random interference patterns, such standing waves are generated with the net acoustic power delivered at each orifice being such that the droplets will break off within the charge electrode region.

In order to meet these conditions, if the orifices in droplet generator 10 have a diameter of 0.003 inch, the fluid plenum may, for example, be stimulated by frequencies within the range of 10 KHz to 22 KHz. For an orifice plate having 0.002 inch diameter orifices, stimulation frequencies of approximately 25 to 35 KHz may be utilized.

The stimulation frequency determines how many drops per second will be generated. As indicated with respect to generating the random interference patterns discussed above in regard to FIGS. 2 and 3, a print time must be selected which will result in at least one drop, on average, being selected during the dark random interference pattern undulations with fewer drops in the white background.

For a 0.003 inch diameter orifice plate, which is stimulated at, for example, 10 KHz, a print time of 1/10 KHz or 100 μsec will result in one drop being formed per print pulse. Similarly, using 10 KHz stimulation, a print time of 200 μsec will result in two drops being generated (by a 0.003 inch diameter orifice) per print pulse. In order for the random interference pattern to be reasonably discernible, the print time must be small enough so that only one or two drops will be formed per print pulse.

Turning back briefly to FIG. 3, this pattern shows a generally dark undulating random interference pattern on a white background. This pattern may be produced with a 0.003 inch orifice jet being stimulated at 10 KHz with a 100 μsec print time whereby one drop defines the pattern and no drops define the background. If the print time were raised to 200 μsec, the random pattern area would receive two drops whereas the background would receive one drop. Thus, the contrast between the two areas would be reduced.

The system of FIG. 4 provides an apparatus for adjusting the print time pulse duration and the center-to-center pixel spacing between occurrences of individual print time pulses along the longitudinal or machine direction of substrate motion. The adjustment of center-to-center pixel spacing in conjunction with proper control over the print time duration of each pixel site allows for the formation of a wide range of random interference patterns.

Although the tachometer 20 is not typically utilized to produce random patterns, the embodiment of FIG. 4 shows the tachometer 20 which is used for solid shade applications where it is is mechanically coupled to track substrate motion. For example, one of the driven rollers of a transport device used to cause substrate motion (or merely a follower wheel or the like) may drive the tachometer 20. The tachometer 20 may comprise a Litton brand shaft encoder Model No. 74BI1000-1 and may be driven by a 3.125 inch diameter tachometer wheel so as to produce one signal pulse at its output for every 0.010 inch of substrate motion in the longitudinal or machine direction.

In random interference pattern generating applications, switch S is set to disconnect tachometer 20 and to connect artificial tachometer signal generator 21. The artificial tachometer signal generator 21 is a signal generating device which provides a means to controllably vary the spacing between the undulating patterns shown in, for example, FIG. 3 to more closely simulate, for example, a wood grain pattern or the like. The signal generator 21 permits great flexibility in random interference pattern generation due to its ability to vary the frequency of signals transmitted to print time controller to controllably vary the frequency of the print pulses.

The artificial tachometer signal generator 21 breaks any correlation between substrate speed and print time frequency, i.e., the print time controller 26 (to be described below) is in effect informed that the substrate speed is other than its actual speed. The print time controller 26 responds to a signal generated by the artificial tachometer signal generator 21 by generating a print pulse of a predetermined fixed duration as will be discussed below.

The artificial tachometer signal generator 21 may simply be an oscillator whose output signals are by way of example only, TTL square wave pulses ranging in amplitude from +5 volts to OV, and whose frequency is controlled by the setting of a vernier control knob. In this embodiment, an operator may vary the random interference pattern by manually adjusting the oscillators frequency control knob. If the false tachometer signal generator 21 is set to generate a fixed frequency, a substantially fixed random interference pattern will result therefrom, e.g., a wood grain pattern.

By varying the frequency of the false tachometer signal generator 21 the random patterns may be varied. For example, if the frequency is varied in a cyclic manner, the resulting random pattern will closely simulate a wood grain pattern having closed knot holes therein. The knot hole effect results from the print cycle approaching being in phase with the stimulation frequency (resulting in a large interference pattern), then rapidly passing the in phase point to move rapidly away from the in phase point thereby resulting in a pattern resembling a closed knot hole. The frequency at which the knot hole effect will occur, i.e., the in phase point, may be readily determined empirically. Further details for generating this and other random patterns may be found in copending application Ser. No. 026,488.

In the solid shade applicator described in application Ser. No. 908,289, an input signal from the tachometer 20 is applied directly to the adjustable ratio signal scaler 22 for each passage of a predetermined increment of substrate movement in the machine direction (e.g., for each 0.010 inch). The ratio between the number of applied input signals and the number of resulting output signals from the signal scaler 22 is adjustable (e.g., by virtue of switch 24).

When generating random interference patterns, signal scaler 22 receives the output signal from artificial tachometer signal generator 21. It is noted, however, that switch 24 is preferably set to position X1 when generating such patterns. When an output signal is produced by the signal scaler 22, then a conventional print time controller 26 generates a print time pulse for the charging electrode 16 (which actually turns the charging electrode "off" for the print time duration in the exemplary embodiment).

The print time controller 26 may, for example, be a monostable multivibrator with a controllable period by virtue of, for example, potentiometer 28, 30 which may constitute a form of print time duration control. For example, the fixed resistor 28 may provide a way to insure that there is always a minimum duration to each print time pulse while the variable resistor 30 may provide a means for varying the duration of the print time pulse at values above such a minimum, but below the maximum print time for random interference patterns to be formed as discussed above. As will be appreciated by those in the art, the generated print time pulses will be conventionally utilized to control high voltage charging electrode supply circuits so as to turn the charging electrode 16 "on" (during the intervals between print times) and "off" (during the print time interval when droplets are permitted to pass on toward the substrate 14).

In solid shade applications, for any given setting of switch 24, there is a fixed center-to-center pixel spacing. For example, if tachometer 20 is assumed to produce a signal each 0.010 inch of substrate movement, and if switch 24 is assumed to be in X1 position, then the center-to-center pixel spacing will also be 0.010 inch because the print time controller 26 will be stimulated once each 0.010 inch. As explained above, with the utilization of artificial tachometer signal generator 21 this correlation does not exist when random interference patterns are generated.

The input to the signal scaler 22 also passes to a digital signal divide circuit 32 (e.g., an integrated COS/-MOS divided by "N" counter conventionally available under integrated circuit type No. CD4018B). The outputs from this divider 32 are used directly or indirectly (via AND gates as shown in FIG. 1) to provide input-/output signal occurrence ratios of 1:1 (when the switch is in the X1 position) to 10:1 (when the switch is in the X10 position) thus resulting in output signal rates from the scaler 22 at the rate of one pulse every 0.010 inch to one pulse every 0.100 inch and such an output pulse rate can be adjusted in 0.010 inch increments via switch 24 in this exemplary embodiment. The FET output buffer VNOIP merely provides electrical isolation between the signal scaler 22 and the print time controller 26 while passing along the appropriately timed stimulus signal pulse to the print time controller 26. Thus, the center-to-center spacing of pixels in the machine direction can be instantaneously adjusted by merely changing the position of switch 24. As will be appreciated by those in the art, there are may possible electrical circuits for achieving such independent but simultaneous control over center-to-center pixel spacing and the duration of print time intervals.

In a further embodiment of the present invention, print time controller 26 may, for example, be implemented by a microprocessor having an associated data entry keyboard, random access memory and programmable read-only memory (PROM), as disclosed in copending application Ser. No. 026,413, which application is expressly incorporated by reference herein. In this embodiment, each of a set of desired random interference patterns may be identified by a digital code. Stored in the PROM and associated with each of these patterns are empirically obtained applicator operating parameters known to produce the desired pattern. After an operator keys in the pattern identifying code, the microprocessor uses the identifying code to address the PROM to obtain, for example, a print time signal and control signals defining the necessary frequency for applying the print time signal to obtain the identified pattern.

As referenced above, two or more piezoelectric crystals may be attached to the bar holding the orifice plate or to the orifice plate itself. By alternate cycling of the amplitude of the vibrations from the various crystals in a manner such that the total power of stimulation is approximately the same, that is, shifting from one piezoelectric crystal to the other while maintaining the desired frequency on both, the random interference pattern ("moire-type") will vary greatly.

If the power (amplitude), for example, on the first crystal, is varying with time in a sine-wave fashion, the second crystal's amplitude can then be made to vary in the same manner 180° out of phase with the amplitude of the first crystal. The overall stimulation energy will remain the same for the bar/plate/fluid; however, the focus will shift, producing additional randomness or variation to that which would already exist if one crystal was used alone or two crystals in synchronous amplitude operation.

In another form hereof, the random interference patterns may be generated locally in short sections of the filament droplet curtain. For example, orifice plates with varying non-uniform spacing, hole-to-hole, may be employed. Thus, a plate may have a hole pattern comprised of ten holes at regular spacing, no hole at the next regular hole position, then nine regularly-spaced holes followed by a blank section equivalent to two regular hole spacings; then follow with eight holes, then three missing, etc. When this series reaches ten missing and one regular hole, this short series can then be repeated until the desired length of orifice plate is completed. Obviously, other types of hole spacings and arrangements may be employed.

In a further form, local control may be accomplished by reducing or minimizing either the charge electrode or deflection electrode (or both) effects. One way to accomplish this is to insulate one or more fluid filaments from the charge and/or deflection electrode voltage. For example, a thin coating of insulating material may be applied in the desired place. Alternatively, more control can be exercised with a moveable insulating device. A "C" shaped insulating part can be easily snapped in place over the electrode ribbon strip at selected positions along its length. An "O" shaped part can be slidably disposed about the electrode so that it may be moved across a ribbon electrode to various locations. In all instances, the pattern generation will be unique.

Further, to facilitate change from one type of charge and/or deflection arrangement to another, electrodes of different charge spacing can be made which are rotatable around their long axis.

Further variation in the "moire-type" patterning can be accomplished by varying the charge timing and time length of the charge using electronic timing circuits.

As indicated above, reference is made to application Ser. No. 026,488 for examples of a variety of random interference patterns applied to various substrates. A random interference pattern printed on a paper substrate is exemplified in FIG. 5. This Figure is merely intended to illustrate a random interference pattern where the interference pattern is superimposed on another pattern. The widely displaced undulations in this exemplary pattern should not be taken as being characteristic of the random interference patterns generated in accordance with the present invention. The fluid jet applicator which produced this sample pattern included individually controllable cross-machine electrodes.

It is also noted that the fluid jet applicator shown in FIG. 4 (having a single ganged electrode) may readily be controlled in the manner taught in copending U.S. application Ser. No. 026,413, entitled "Patterning Effects with Fluid Jet Applicator", to produce, for example, random interference patterns in the form of cross machine or vertical bands of a predetermined width, etc. By using the patterning control techniques taught in this application, the fluid jet applicator shown in FIG. 4 may, by way of example only, be controlled to dispose a random interference pattern in a predetermined border area of paper currency such as area F shown in FIG. 1.

The present invention contemplates still further uses in the document security field for the above-described random patterns. For example, a generated random pattern may be used as an identifier on identification cards, keys or the like. In this regard, a fluid jet applicator such as shown in FIG. 4 may be controlled as described above to generate a random pattern on a predetermined area of a card. Due to its uniqueness, such a pattern may be advantageously utilized as a security identification code, for example, for an employee identification card.

The pattern applied to the employee's identification card may be scanned by, for example, a CCD optical scanner, digitized and stored in the memory of a digital computer in association with the employee's name. In order to, for example, gain admittance to a high security area, it is contemplated that the employee will have such an ID card scanned by an optical character reader. A digitized code representing the scanned pattern will then be forwarded to the digital computer for comparison with the previously recorded patterns. If there is a match, the employee will be permitted to enter the restricted area. Enhanced security is thereby achieved using such patterns as identification codes in view of the extreme difficulty in accurately reproducing the pattern.

While only one presently preferred exemplary embodiment of this invention has been described in detail, those skilled in the art will recognize that many modifications and variations may be made in this exemplary embodiment while yet retaining many of the advantageous novel features and results. Accordingly, all such modifications and variations are intended to be included within the scope of the following claims.

What is claimed:

1. A method of detecting document counterfeiting using a fluid jet applicator having a fluid plenum and an associated orifice array and means for selectively passing droplets onto a moving document substrate only during controlled print times having a print time duration T, comprising the steps of:

purposefully generating standing waves within the fluid plenum;

establishing an on/off print cycle pattern including, during said on print cycle, selectively passing droplets onto a moving document substrate only during controlled print times having the print time duration T;

maintaining the print time duration T below a predetermined maximum value, including selecting the print time duration T such that no more than about one droplet per orifice of the orifice array is formed during such print time duration T, thereby causing, during such print time duration T, an interaction between the standing waves and the on/-off print cycle pattern to form a unique random pattern on said substrate; and applying the unique random pattern through the orifice array to a predetermined portion of each of a set of original document substrates, whereby, after a plurality of such documents have been distributed, counterfeit documents may be detected by visually comparing documents and checking for documents having random patterns which are exact copies.

2. A method according to claim 1, further including the steps of:

generating a predetermined pattern and applying said pattern to each of said set of documents; and superimposing a random interference pattern over said predetermined pattern on each of said documents.

3. A method according to claim 1, wherein said step of purposefully generating includes the steps of:

applying artificial stimulation to said fluid plenum to produce a standing wave pattern; and purposefully varying the standing wave pattern to modify a currently generated random interference pattern.

4. A method according to claim 1, wherein said applying step includes:

applying the random pattern to a predetermined portion of each of a set of paper currency.

5. A method according to claim 1, wherein said fluid jet applicator includes a fluid plenum and an associated orifice array, said method further including the steps of:

loading a fluid into said fluid plenum which is not normally visible when applied to the document substrate when viewed in ambient light; and applying said random pattern to each of said original document substrates with said fluid which is not normally visible, whereby each of said documents must be illuminated with light of a predetermined frequency in order to render visible said random pattern.

6. A method according to claim 5, wherein said fluid comprises an ultraviolet visible fluorescent brightener.

7. A method according to claim 5, wherein said fluid is a stilbene compound.

8. A method according to claim 5, further including the step of treating the entire document with said fluid to dispose a random interference pattern over the entire document.

9. A method according to claim 5, further including the steps of:

printing all document indicia on said document substrates prior to applying said fluid which is not normally visible; and thereafter applying said fluid to said printed document.

10. A method of detecting document counterfeiting using a fluid jet applicator having a fluid plenum and an associated orifice array and means for selectively passing droplets onto a moving document substrate only during controlled print times having a print time duration T, comprising the steps of:

purposefully generating standing waves within the fluid plenum;

establishing an on/off print cycle pattern including, during said on print cycle, selectively passing droplets onto a moving document substrate only during controlled print times having the print time duration T;

maintaining the print time duration T below a predetermined maximum value, including selecting the print time duration T such that only about two droplets per orifice of the orifice array are formed during such print time duration T, thereby causing, during such print time duration T, an interaction between the standing waves and the on/off print cycle pattern to form a unique random pattern on said substrate; and applying the unique random pattern through the orifice array to a predetermined portion of each of a set of original document substrates, whereby, after a plurality of such documents have been distributed, counterfeit documents may be detected by visually comparing documents and checking for documents having random patterns which are exact copies.

11. A method according to claim 10, further including the steps of:

generating a predetermined pattern and applying said pattern to each of said set of documents; and superimposing a random interference pattern over said predetermined pattern on each of said documents.

12. A method according to claim 10, wherein said step of purposefully generating includes the steps of:

applying artificial stimulation to said fluid plenum to produce a standing wave pattern; and purposefully varying the standing wave pattern to modify a currently generated random interference pattern.

13. A method according to claim 10, wherein said applying step includes:

applying the random pattern to a predetermined portion of each of a set of paper currency.

14. A method according to claim 10, wherein said fluid jet applicator includes a fluid plenum and an associated orifice array, said method further including the steps of:

loading a fluid into said fluid plenum which is not normally visible when applied to the document substrate when viewed in ambient light; and applying said random pattern to each of said original document substrates with said fluid which is not normally visible, whereby each of said documents must be illuminated with light of a predetermined frequency in order to render visible said random pattern.

15. A method according to claim 14, wherein said fluid comprises an ultraviolet visible fluorescent brightener.

16. A method according to claim 14, wherein said fluid is a stilbene compound.

17. A method according to claim 14, further including the step of treating the entire document with said fluid to dispose a random interference pattern over the entire document.

18. A method according to claim 14, further including the steps of:

printing all document indicia on said document substrates prior to applying said fluid which is not normally visible; and thereafter applying said fluid to said printed document.

19. A method for detecting the counterfeiting of articles using a fluid-jet applicator having a fluid plenum and an associated orifice array and means for selectively passing droplets onto the articles only during controlled print times having a print time duration T, comprising the steps of:

purposefully generating standing waves within the fluid plenum;

establishing an on/off print cycle pattern including, during said on print cycle, selectively passing droplets onto a moving document substrate only during controlled print times having the print time duration T;

maintaining the print time duration T below a predetermined maximum value, including selecting the print time duration T such that no more than about two droplets per orifice of the orifice array are formed during such print time duration T, thereby causing, during such print time duration T, an interaction between the standing waves and the on/-off print cycle pattern to form a unique random pattern on each of a plurality of a set of original articles using the fluid-jet applicator;

placing the articles in public circulation;

checking the genuineness of a plurality of the publicly-circulated articles by comparing the random patterns on each article, whereby if any two of the plurality of articles are exact copies of each other, at least one of said copies is identified as a counterfeit.

20. A method according to claim 19, including the steps of:

loading a fluid into said fluid plenum which is not normally visible when applied to an article when viewed in ambient light; and applying said random pattern to each of said original articles with said fluid which is not normally visible, whereby each of said articles must be illuminated with light of a predetermined frequency to render visible said random pattern.

21. A method according to claim 20, wherein said fluid comprises an ultraviolet visible fluorescent brightener.

22. A method according to claim 20, further including the step of treating the entire article with said fluid to dispose a random interference pattern over the entire article.

23. A method according to claim 20, including the steps of:

printing all article indicia on said article prior to applying said fluid which is not normally visible; and applying thereafter said fluid to said article.

24. Apparatus for detecting counterfeiting comprising:

fluid jet applicator means for applying fluid to moving substrates, said fluid jet applicator means having a fluid plenum and an associated orifice array and means for selectively passing droplets onto the moving substrates only during controlled print times having a duration T;

means for controlling said fluid jet applicator to apply a unique random pattern to at least a predetermined portion of each substrate, said means for controlling including:

means for purposefully generating standing waves within the fluid plenum;

means for establishing an on/off print cycle pattern including, during said on print cycle, selectively passing droplets onto the moving substrates only during controlled print times having the print time duration T; and means for maintaining the print time duration T below a predetermined maximum value, the maintaining means including means for selecting a print time such that no more than about two droplets per orifice of the orifice array are formed during such print time duration T, thereby causing an interaction between the standing waves and the on/off print cycle pattern to form a random interference pattern on each of said substrates.

25. Apparatus according to claim 24, wherein said means for purposefully generating includes means for applying artificial stimulation to said fluid plenum;

means for generating a pattern and applying said pattern to each of said set of substrates; and means for superimposing a random interference pattern over said pattern on each of said substrates.

26. Apparatus according to claim 24, wherein said means for purposefully generating includes means for applying artificial stimulation to said fluid plenum to produce a standing wave pattern; and means for purposefully varying the standing wave pattern to modify the currently generating random interference pattern.

27. A method of detecting document counterfeiting using a fluid jet applicator having a fluid plenum and an associated orifice array comprising the steps of:

purposefully generating standing waves within the fluid plenum to generate droplets out of phase with one another across the plenum;

establishing an on/off print cycle pattern including, during said on print cycle, selectively passing droplets onto a moving document substrate only during controlled print times having a print time duration T;

maintaining the print time duration T below a predetermined maximum value such that an interaction between the standing waves and the on/off print cycle pattern causes the droplets to form a unique random pattern on said substrate; and applying the unique random pattern through the orifice array to a predetermined portion of each of a set of original document substrates, whereby, after a plurality of such documents have been distributed, counterfeit documents may be detected by visually comparing documents and checking for documents having random patterns which are exact copies.

28. A method according to claim 27, wherein the step of maintaining the print time below a predetermined maximum value includes the step of selecting a print time such that no more than about one droplet per orifice is formed during such print time duration T.

29. A method according to claim 27, wherein the step of maintaining the print time duration T below a predetermined maximum value includes the step of selecting a print time such that only about two droplets per orifice are formed during such time.

30. A method according to claim 27, wherein said step of purposefully generating includes the steps of:

applying artificial stimulation to said fluid plenum to produce a standing wave pattern; and purposefully varying the standing wave pattern to modify a currently generated random interference pattern.

* * * * *